US010115330B2

(12) United States Patent
Li

(10) Patent No.: US 10,115,330 B2
(45) Date of Patent: Oct. 30, 2018

(54) CONVERTING METHODS OF DRIVING DATA OF DISPLAY PANELS AND CONVERTING SYSTEMS

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Man Li, Shenzhen (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 370 days.

(21) Appl. No.: 14/889,193

(22) PCT Filed: May 4, 2015

(86) PCT No.: PCT/CN2015/078219
§ 371 (c)(1),
(2) Date: Nov. 5, 2015

(87) PCT Pub. No.: WO2016/155080
PCT Pub. Date: Oct. 6, 2016

(65) Prior Publication Data

US 2017/0046994 A1 Feb. 16, 2017

(30) Foreign Application Priority Data

Mar. 27, 2015 (CN) ..... 2015 1 0139902

(51) Int. Cl.
*G09G 3/20* (2006.01)
*G09G 3/3266* (2016.01)
(Continued)

(52) U.S. Cl.
CPC ..... *G09G 3/2003* (2013.01); *G09G 3/3266* (2013.01); *G09G 3/3677* (2013.01);
(Continued)

(58) Field of Classification Search
CPC ..... G09G 3/2003; G09G 3/3266
See application file for complete search history.

(56) References Cited

U.S. PATENT DOCUMENTS

2009/0046307 A1* 2/2009 Kwak ..... G09G 5/02 358/1.9
2015/0138227 A1* 5/2015 Zhao ..... H04N 5/57 345/601
2015/0364081 A1* 12/2015 Tseng ..... G09G 3/3413 345/694

* cited by examiner

*Primary Examiner* — Alexander Eisen
*Assistant Examiner* — Mansour M Said
(74) *Attorney, Agent, or Firm* — Andrew C. Cheng

(57) ABSTRACT

A converting method of driving data of display panels having a plurality of display areas includes: A) initializing M to be zero; B) A(m, n)=1−q×M, wherein q is greater than zero and smaller than one, (m, n) represents a coordinate of the display area, and A(m, n) represents to adjustment parameters corresponding to the display area; C) converting inputted RGB data into intermediate RGBW data corresponding to the display area in accordance with the adjustment parameter; D) calculating a color saturation value of the HSV color space in accordance with the intermediate RGBW data; E) determining whether the color saturation value is not smaller than a predetermined saturation value corresponding to the display area; and F) outputting the intermediate RGBW data when the color saturation value is not smaller than the predetermined saturation value.

15 Claims, 3 Drawing Sheets

(51) Int. Cl.
*G09G 3/36* (2006.01)
*G09G 3/3275* (2016.01)

(52) U.S. Cl.
CPC ..... *G09G 3/3275* (2013.01); *G09G 3/3688* (2013.01); *G09G 2300/0452* (2013.01); *G09G 2310/0275* (2013.01); *G09G 2320/0666* (2013.01)

CONVERTING METHODS OF DRIVING DATA OF DISPLAY PANELS AND CONVERTING SYSTEMS

BACKGROUND OF THE INVENTION

1. Field of the Invention

The present disclosure relates to display technology, and more particularly to a converting method of driving data of display panels and a converting system.

2. Discussion of the Related Art

With respect to display devices having liquid crystal display panels or OLED display panels, one pixel cell is configured to include a red subpixel (R), a green subpixel (G), and a blue subpixel (B). Images are displayed by mixing colors needed to be displayed by controlling the R-data, G-data, B-data respectively from the above subpixels.

It can be understood that a variety of demands toward the display panels has been increased with the development of the technology, such as high transmission rate, low power consumption, and better image quality. Currently, as the original RGB displaying method has a lower transmission rate and mixing efficiency, the power consumption of the display panels is high. As a result, the display panel with the subpixel having the R-subpixel, the G-subpixel, the B-subpixel, and a fourth subpixel has been developed. In an example, the fourth subpixel may be a white-subpixel (W). Thus, the display quality of the display panels may be enhanced.

Regarding the display panels having the four subpixels, a minimum value of the inputted RGB data is configured to be a W value to be outputted. Under the circumstance, the brightness of the display panels has been greatly enhanced. In addition, the power consumption of the display devices has been decreased. However, compared to the display panels having the R, G, B subpixles, the color range and the saturation of the display devices are lower.

SUMMARY

In one aspect, a converting method of driving data of display panels, the display panel comprises a plurality of display areas, the method includes: A) initializing M to be zero; B) configuring A(m, n)=1−q×M, wherein q is greater than zero and smaller than one, (m, n) represents a coordinate of the display area, and A(m, n) represents to adjustment parameters corresponding to the display area; C) converting inputted RGB data into intermediate RGBW data corresponding to the display area in accordance with the adjustment parameter; D) calculating a color saturation value of a HSV color space in accordance with the intermediate RGBW data; E) determining whether the color saturation value is not smaller than a predetermined saturation value corresponding to the display area; and F) outputting the intermediate RGBW data when the color saturation value is not smaller than the predetermined saturation value.

The method further includes: G) configuring M to be M+1 when the color saturation value is smaller than the predetermined saturation value; H) determining whether M is smaller than ten; and I) executing step B) upon determining M is smaller than ten.

Wherein the method further includes: J) outputting the intermediate RGBW data if M is not smaller than ten.

Wherein in step C), the inputted RGB data is converted into the intermediate RGBW data by the equation below:

$$w=\min(Ri,Gi,Bi)\times A(m,n);$$

$$r=Ri-w;$$

$$g=Gi-w;$$

$$b=Bi-w;$$

wherein Ri represents the inputted R data, Gi represents the inputted G data, Bi represents the inputted B data, w represents the intermediate W data, r represents the intermediate R data, g represents the intermediate G data, and b represents the intermediate B data.

Wherein in step D), the color saturation value is calculated in accordance with the intermediate RGBW data by the equation below:

$$h=\begin{cases} 0^\circ, \text{ if } \max=\min \\ 60^\circ\times\dfrac{g-b}{\max-\min}+0^\circ, \text{ if } \max=r \text{ and } g\geq b \\ 60^\circ\times\dfrac{g-b}{\max-\min}+360^\circ, \text{ if } \max=r \text{ and } g<b \\ 60^\circ\times\dfrac{b-r}{\max-\min}+120^\circ, \text{ if } \max=g \\ 60^\circ\times\dfrac{r-g}{\max-\min}+240^\circ, \text{ if } \max=b \end{cases}$$

$$s=\begin{cases} 0, \text{ if } \max=0 \\ \dfrac{\max-\min}{\max}=1-\dfrac{\min}{\max}, \text{ Otherwise} \end{cases}$$

$$v=\max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

In another aspect, a converting system of driving data of display panels, the display panel comprises a plurality of display areas, the system includes: an initialization unit initializing M to be zero; a first assignment-value unit configuring A(m, n)=1, wherein A(m, n) represents adjustment parameters corresponding to the display area having the coordinate (m, n); a data conversion unit converting inputted RGB data into intermediate RGBW data corresponding to the display area in accordance with the adjustment parameter A(m,n); a saturation computing unit calculating a color saturation value of a HSV color space in accordance with the intermediate RGBW data; a saturation comparing unit determining whether the color saturation value is not smaller than a predetermined saturation value corresponding to the display area; and an output unit outputting the intermediate RGBW data if the saturation value is not smaller than the predetermined saturation value.

Wherein the system further includes: a second assignment-value unit configuring M to be M+1 if the saturation value is smaller than the predetermined saturation value; a determination unit determining whether M is larger than ten; and the output unit outputting the intermediate RGBW data if M is not smaller than ten.

Wherein the first assignment-value unit configures A(m, n)=1−q×M upon determining M is smaller than 0, and wherein q is greater than zero and smaller than one.

Wherein the data conversion unit converts the inputted RGB data into the intermediate RGBW data corresponding to the display area in accordance with the adjustment parameters by the equation below:

$$w=\min(Ri,Gi,Bi)\times A(m,n);$$

$$r=Ri-w;$$

$$g=Gi-w;$$

$$b=Bi-w;$$

Wherein Ri represents the inputted R data, Gi represents the inputted G data, Bi represents the inputted B data, w represents the intermediate W data, r represents the intermediate R data, g represents the intermediate G data, and b represents the intermediate B data.

Wherein the saturation computing unit calculates the color saturation value of the HSV color space in accordance with the intermediate RGBW data by the equation below:

$$h=\begin{cases} 0^\circ, \text{ if } \max=\min \\ 60^\circ\times\dfrac{g-b}{\max-\min}+0^\circ, \text{ if } \max=r \text{ and } g\geq b \\ 60^\circ\times\dfrac{g-b}{\max-\min}+360^\circ, \text{ if } \max=r \text{ and } g<b \\ 60^\circ\times\dfrac{b-r}{\max-\min}+120^\circ, \text{ if } \max=g \\ 60^\circ\times\dfrac{r-g}{\max-\min}+240^\circ, \text{ if } \max=b \end{cases}$$

$$s=\begin{cases} 0, \text{ if } \max=0 \\ \dfrac{\max-\min}{\max}=1-\dfrac{\min}{\max}, \text{ Otherwise} \end{cases}$$

$$v=\max;$$

Wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

In view of the above, the converting method and system of the driving data are capable of enhancing the color saturation of the display device so as to improve the display performance.

DETAILED DESCRIPTION OF THE EMBODIMENTS

Figure 1:
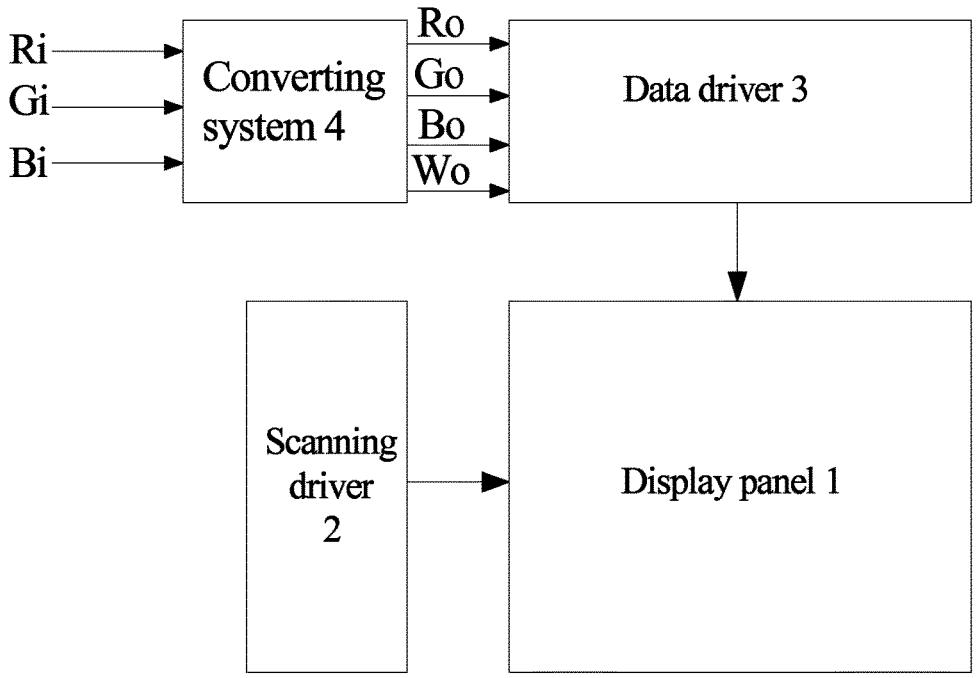
FIG. 1 is a block diagram of the display device in accordance with one embodiment.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

The display device may be a liquid crystal device (LCD) or an organic light emitting device (OLED).

Figure 2:
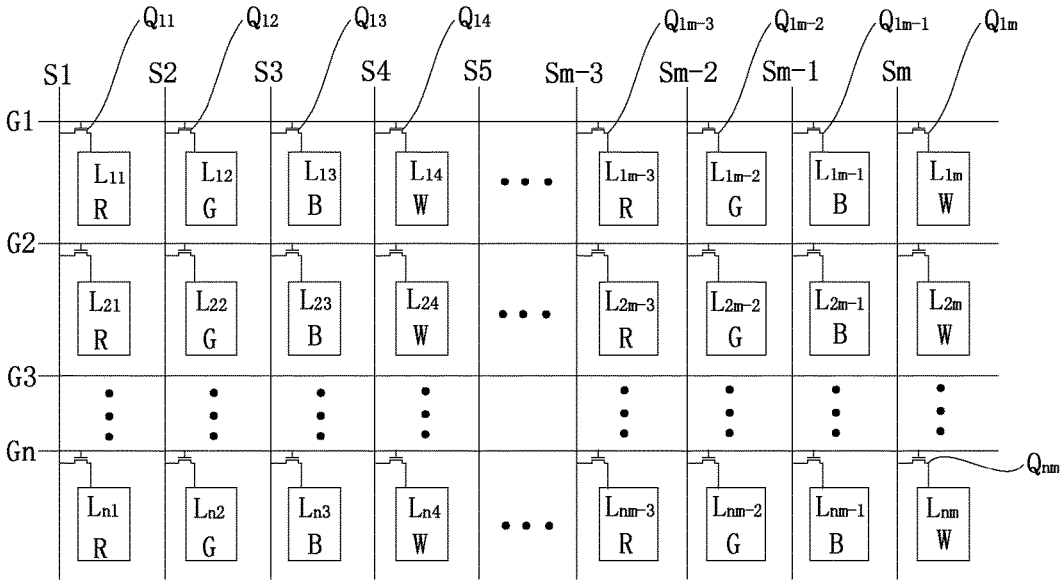
FIG. 2 is a schematic view showing the structure of the display panel in accordance with one embodiment.

FIG. 1 is a block diagram of the display device in accordance with one embodiment. FIG. 2 is a structural diagram of the display panel in accordance with one embodiment.

Referring to FIGS. 1 and 2, the display device includes a display panel 1, a scanning driver 2, a data driver 3, and a converting system of the driving data of the display panel 4 ("converting system 4").

The display panel 1 includes a plurality of scanning lines G1 through Gn extending along a row direction and a plurality of data lines S1 through Sm extending along a column direction, wherein n and m are natural numbers. All of the scanning lines G1 through Gn connect to the scanning driver 2, and all of the data lines S1 through Sm connect to the data driver 3.

The subpixel Lij is arranged within the area defining by the scanning line Gi, Gi+1 and the data lines Sj, Sj+1, wherein i is an integer in a range between 1 and n and j is an integer in a range between 1 and m. The subpixel Lij may be a red subpixel (R), a green subpixel (G), a blue subpixel (B), and a white subpixel (W). In addition, one red subpixel (R), one green subpixel (G), one blue subpixel (B), and one white subpixel (W) constitute a pixel.

The TFT (Qij) is arranged in a rim of the intersection of the scanning line (Gi) and the data line (Sj).

In addition, the scanning line (Gi) connects to a gate of the TFT (Qij). The data line (Sj) connects to a source of the TFT (Qij). The subpixel (Lij) connects to a drain of the TFT (Qij). The subpixel (Lij) may be the red subpixel (R), the green subpixel (G), the blue subpixel (B) or the white subpixel (W).

The scanning driver 2 and the data driver 3 are arranged in a rim of the display panel 1. The converting system 4 converts the inputted RGB data into an outputted RGBW data, and then provides the RGBW data to the data driver 3. In an example, the inputted RGB data may be provided by an external device or an image controller (not shown).

The data driver 3 receives the inputted RGBW data from the converting system 4 and then generates simulated data signals to the data lines S1 through Sm. The scanning driver 2 provides a plurality of scanning signals to the scanning lines G1 through Gn. The display panel 1 is configured to display images in accordance with the simulated data signals from the data driver 3 and the scanning signals from the scanning driver 2.

Figure 3:
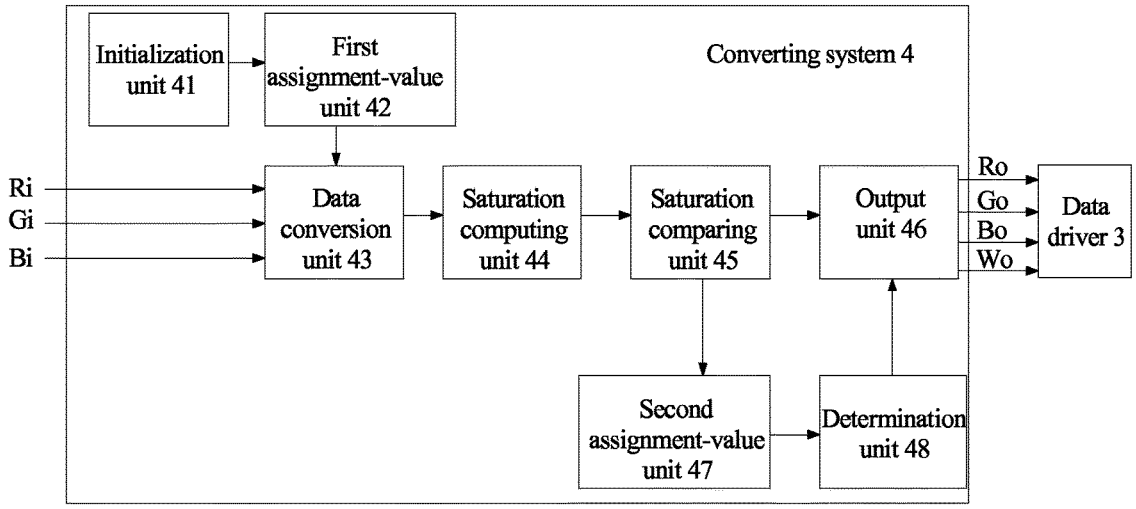
FIG. 3 is a block diagram of the converting system of the driving data of the display panel in accordance with one embodiment.

FIG. 3 is a block diagram of the converting system of the driving data of the display panel in accordance with one embodiment.

Referring to FIG. 3, the converting system 4 includes an initialization unit 41, a first assignment-value unit 42, a data conversion unit 43, a saturation computing unit 44, a saturation comparing unit 45, a second assignment-value unit 47, a determination unit 48, and an output unit 46. In an example, the converting system 4 may include other units other than the above-mentioned units. Similarly, the above-mentioned units may be combined to be one component.

Figure 4:
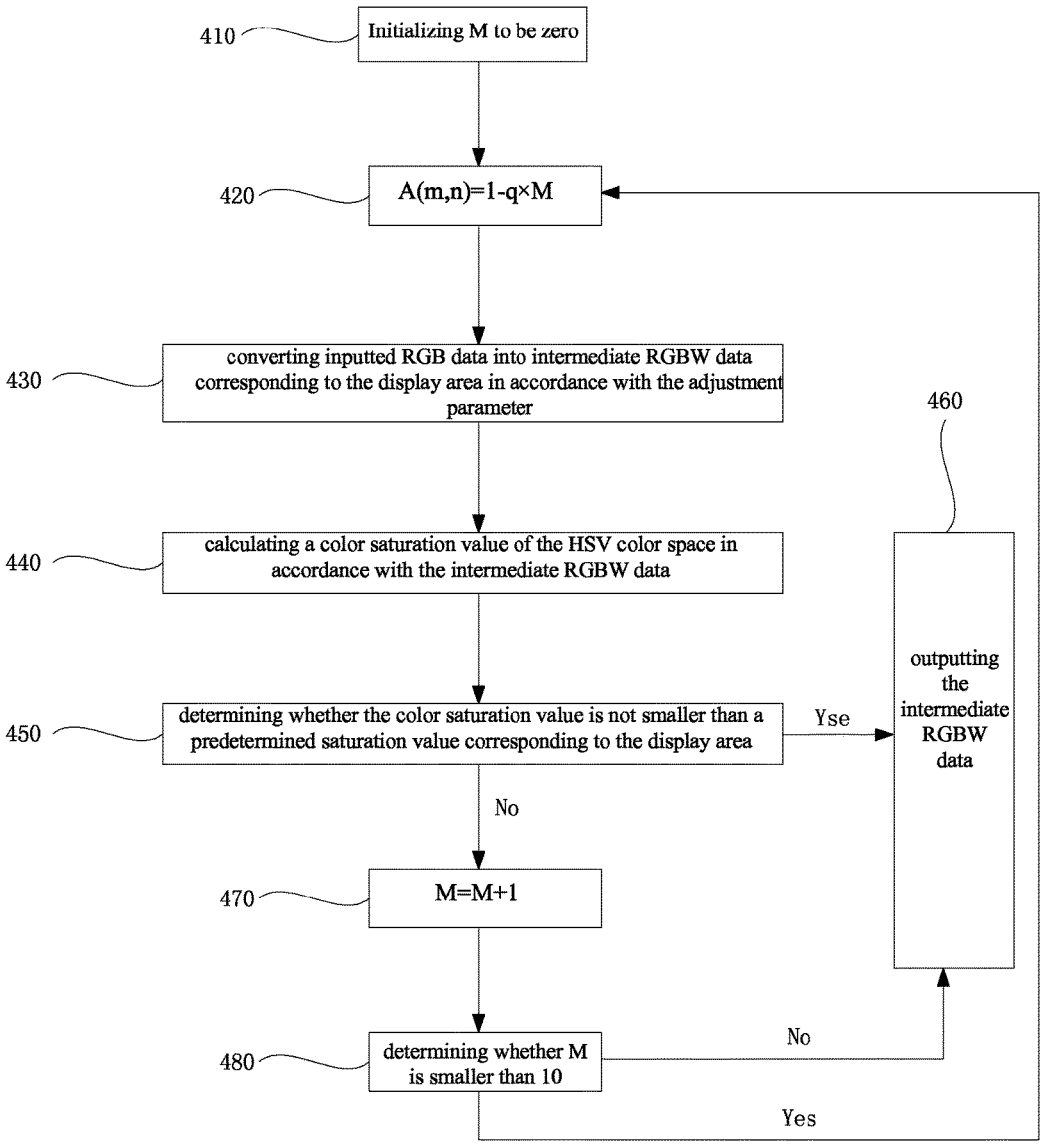
FIG. 4 is a flowchart illustrating the converting method of the driving data of the display panels in accordance with one embodiment.

First, it is to be noted that the display panel 1 is divided into a plurality of display areas. As shown in FIG. 4, the display panel 1 is divided into, but not limited to, 12 display areas. The coordinates are shown as (m, n), wherein m and n are integers, and $3 \geq m \geq 1$, $4 \geq n \geq 1$.

Specifically, in regard to each of the display areas, the RGB data are inputted to the data conversion unit 43.

The initialization unit 41 configures M to be zero.

The first assignment-value unit 2 configures A(m, n)=1, wherein A(m, n) represents adjustment parameters corresponding to the display area with the coordinate (m, n).

The data conversion unit 43 converts the inputted RGB data into the intermediate RGBW data in accordance with the adjustment parameter A(m, n) corresponding to the display area.

In addition, the data conversion unit 43 converts the inputted RGB data into the intermediate RGBW data in accordance with the adjustment parameter A(m, n) by Equation 1.

$$w=\min(Ri,Gi,Bi)\times A(m,n)$$

$$r=Ri-w$$

$$g=Gi-w$$

$$b=Bi-w \qquad \text{[Equation 1]}$$

Wherein Ri represents the inputted R data, Gi represents the inputted G data, Bi represents the inputted B data, w represents the intermediate W data, r represents the intermediate R data, g represents the intermediate G data, and b represents the intermediate B data.

The saturation computing unit 44 calculates the color saturation value of the HSV color space in accordance with the intermediate RGBW data.

In addition, the saturation computing unit 44 calculates the color saturation value of the HSV color space in accordance with the intermediate RGBW data by Equation 2.

$$h=\begin{cases} 0^\circ, \text{ if } \max=\min \\ 60^\circ\times\dfrac{g-b}{\max-\min}+0^\circ, \text{ if } \max=r \text{ and } g\geq b \\ 60^\circ\times\dfrac{g-b}{\max-\min}+360^\circ, \text{ if } \max=r \text{ and } g<b \\ 60^\circ\times\dfrac{b-r}{\max-\min}+120^\circ, \text{ if } \max=g \\ 60^\circ\times\dfrac{r-g}{\max-\min}+240^\circ, \text{ if } \max=b \end{cases} \qquad \text{[Equation 2]}$$

$$s=\begin{cases} 0, \text{ if } \max=0 \\ \dfrac{\max-\min}{\max}=1-\dfrac{\min}{\max}, \text{ Otherwise} \end{cases}$$

$$v=\max$$

Wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

The saturation comparing unit 45 determines whether the color saturation value is not smaller than a predetermined saturation value corresponding to the display area.

The output unit 46 outputs the intermediate RGBW data if the saturation value is not smaller than the predetermined saturation value.

If the saturation value is not smaller than the predetermined saturation value, the second assignment-value unit 47 configures M=M+1.

The determination unit 48 determines whether M is smaller than ten.

If M is not smaller than ten, the output unit 46 outputs the intermediate RGBW data.

If M is smaller than zero, the first assignment-value unit 42 configures A(m,n)=1−q×M, wherein q is greater than zero and smaller than one.

FIG. 4 is a flowchart illustrating the converting method of the driving data of the display panels in accordance with one embodiment.

Referring to FIG. 4, in step 410, the converting system converting the inputted RGB data to the outputted RGBW data initialized M to be zero.

In step 420, the converting system configures A(m,n)=1−q×M, wherein q is greater than zero and smaller than one, (m, n) represents the coordinate of the display area, and A(m, n) represents the adjustment parameters corresponding to the display area.

In step 430, the inputted RGB data is converted into the intermediate RGBW data corresponding to the display area in accordance with the adjustment parameter. In addition, the above conversion is conducted by the above Equation 1.

In step 440, the color saturation value of the HSV color space is calculated in accordance with the intermediate RGBW data. In addition, the above calculation is conducted by the above Equation 2.

In step 450, a determination regarding whether the color saturation value is not smaller than a predetermined saturation value corresponding to the display area is made.

If the saturation value is not smaller than the predetermined saturation value, the process goes to step 460. In step 460, the intermediate RGBW data is outputted.

If the saturation value is smaller than the predetermined saturation value, the process goes to step 470. In step 470, the converting system configures M=M+1.

In step 480, a determination is made regarding whether M is smaller than ten. If M is smaller than ten, the process goes to step 420. If M is not smaller than ten, the process goes to step 460.

In view of the above, the converting method and system of the driving data are capable of enhancing the color saturation of the display device so as to improve the display performance.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A converting method of driving data of display panels, the display panel comprises a plurality of display areas, the method comprising:

A) initializing M to be zero;

B) configuring A(m, n)=1−q×M, wherein q is greater than zero and smaller than one, (m, n) represents a coordinate of the display area, and A(m, n) represents to adjustment parameters corresponding to the display area;

C) converting inputted RGB data into intermediate RGBW data corresponding to the display area in accordance with the adjustment parameter;

D) calculating a color saturation value of a HSV color space in accordance with the intermediate RGBW data;

E) determining whether the color saturation value is not smaller than a predetermined saturation value corresponding to the display area; and F) outputting the intermediate RGBW data when the color saturation value is not smaller than the predetermined saturation value;

G) configuring M to be M+1 when the color saturation value is smaller than the predetermined saturation value;

H) determining whether M is smaller than ten;

I) executing step B) upon determining M is smaller than ten; and wherein the intermediate RGBW data are transmitted to a data driver to display image.

2. The converting method as claimed in claim 1, wherein the method further comprises:

J) outputting the intermediate RGBW data if M is not smaller than ten.

3. The converting method as claimed in claim 2, wherein in step C), the inputted RGB data is converted into the intermediate RGBW data by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

4. The converting method as claimed in claim 2, wherein in step D), the color saturation value is calculated in accordance with the intermediate RGBW data by the equation below:

$$h=\begin{cases}0^\circ, \text{ if } \max=\min\\ 60^\circ\times\dfrac{g-b}{\max-\min}+0^\circ, \text{ if } \max=r \text{ and } g\geq b\\ 60^\circ\times\dfrac{g-b}{\max-\min}+360^\circ, \text{ if } \max=r \text{ and } g<b\\ 60^\circ\times\dfrac{b-r}{\max-\min}+120^\circ, \text{ if } \max=g\\ 60^\circ\times\dfrac{r-g}{\max-\min}+240^\circ, \text{ if } \max=b\end{cases}$$

$$s=\begin{cases}0, \text{ if } \max=0\\ \dfrac{\max-\min}{\max}=1-\dfrac{\min}{\max}, \text{ Otherwise}\end{cases}$$

$$v=\max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

5. The converting method as claimed in claim 1, wherein in step C), the inputted RGB data is converted into the intermediate RGBW data by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

6. The converting method as claimed in claim 1, wherein in step C), the inputted RGB data is converted into the intermediate RGBW data by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

7. The converting method as claimed in claim 1, wherein in step D), the color saturation value is calculated in accordance with the intermediate RGBW data by the equation below:

$$h=\begin{cases}0^\circ, \text{ if } \max=\min\\ 60^\circ\times\dfrac{g-b}{\max-\min}+0^\circ, \text{ if } \max=r \text{ and } g\geq b\\ 60^\circ\times\dfrac{g-b}{\max-\min}+360^\circ, \text{ if } \max=r \text{ and } g<b\\ 60^\circ\times\dfrac{b-r}{\max-\min}+120^\circ, \text{ if } \max=g\\ 60^\circ\times\dfrac{r-g}{\max-\min}+240^\circ, \text{ if } \max=b\end{cases}$$

$$s=\begin{cases}0, \text{ if } \max=0\\ \dfrac{\max-\min}{\max}=1-\dfrac{\min}{\max}, \text{ Otherwise}\end{cases}$$

$$v=\max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

8. The converting method as claimed in claim 1, wherein in step D), the color saturation value is calculated in accordance with the intermediate RGBW data by the equation below:

$$h=\begin{cases}0^\circ, \text{ if } \max=\min\\ 60^\circ\times\frac{g-b}{\max-\min}+0^\circ, \text{ if } \max=r \text{ and } g\geq b\\ 60^\circ\times\frac{g-b}{\max-\min}+360^\circ, \text{ if } \max=r \text{ and } g<b\\ 60^\circ\times\frac{b-r}{\max-\min}+120^\circ, \text{ if } \max=g\\ 60^\circ\times\frac{r-g}{\max-\min}+240^\circ, \text{ if } \max=b\end{cases}$$

$$s=\begin{cases}0, \text{ if } \max=0\\ \frac{\max-\min}{\max}=1-\frac{\min}{\max}, \text{ Otherwise}\end{cases}$$

$$v=\max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

9. A converting system of driving data of display panels, the display panel comprises a plurality of display areas, the system comprising:

an initialization unit initializing M to be zero;

a first assignment-value unit configuring A(m, n)=1, wherein A(m, n) represents adjustment parameters corresponding to the display area having the coordinate (m, n);

a data conversion unit converting inputted RGB data into intermediate RGBW data corresponding to the display area in accordance with the adjustment parameter A(m, n);

a saturation computing unit calculating a color saturation value of a HSV color space in accordance with the intermediate RGBW data;

a saturation comparing unit determining whether the color saturation value is not smaller than a predetermined saturation value corresponding to the display area;

an output unit outputting the intermediate RGBW data if the saturation value is not smaller than the predetermined saturation value;

a second assignment-value unit configuring M to be M+1 if the saturation value is smaller than the predetermined saturation value;

a determination unit determining whether M is larger than ten;

the output unit outputting the intermediate RGBW data if M is not smaller than ten;

wherein the intermediate RGBW data are transmitted to a data driver to display image, and wherein the first assignment-value unit configures A(m, n=1−q×M upon determining M is smaller than 10, and wherein q is greater than zero and smaller than one.

10. The converting system as claimed in claim 9, wherein the data conversion unit converts the inputted RGB data into the intermediate RGBW data corresponding to the display area in accordance with the adjustment parameters by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

11. The converting system as claimed in claim 9, wherein the data conversion unit converts the inputted RGB data into the intermediate RGBW data corresponding to the display area in accordance with the adjustment parameters by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

12. The converting system as claimed in claim 9, wherein the data conversion unit converts the inputted RGB data into the intermediate RGBW data corresponding to the display area in accordance with the adjustment parameters by the equation below:

$$w=\min(Ri,Gi,Bi)\times A(m,n)$$

$$r=Ri-w$$

$$g=Gi-w$$

$$b=Bi-w$$

wherein Ri represents the inputted R data, Gi represents the inputted G data, Bi represents the inputted B data, w represents the intermediate W data, r represents the intermediate R data, g represents the intermediate G data, and b represents the intermediate B data.

13. The converting system as claimed in claim 9, wherein the saturation computing unit calculates the color saturation value of the HSV color space in accordance with the intermediate RGBW data by the equation below:

$$h=\begin{cases}0^\circ, \text{ if } \max=\min\\ 60^\circ\times\frac{g-b}{\max-\min}+0^\circ, \text{ if } \max=r \text{ and } g\geq b\\ 60^\circ\times\frac{g-b}{\max-\min}+360^\circ, \text{ if } \max=r \text{ and } g<b\\ 60^\circ\times\frac{b-r}{\max-\min}+120^\circ, \text{ if } \max=g\\ 60^\circ\times\frac{r-g}{\max-\min}+240^\circ, \text{ if } \max=b\end{cases}$$

$$s=\begin{cases}0, \text{ if } \max=0\\ \frac{\max-\min}{\max}=1-\frac{\min}{\max}, \text{ Otherwise}\end{cases}$$

$$v=\max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

14. The converting system as claimed in claim 9, wherein the saturation computing unit calculates the color saturation value of the HSV color space in accordance with the intermediate RGBW data by the equation below:

$$h = \begin{cases} 0°, \text{ if } \max = \min \\ 60° \times \dfrac{g-b}{\max - \min} + 0°, \text{ if } \max = r \text{ and } g \geq b \\ 60° \times \dfrac{g-b}{\max - \min} + 360°, \text{ if } \max = r \text{ and } g < b \\ 60° \times \dfrac{b-r}{\max - \min} + 120°, \text{ if } \max = g \\ 60° \times \dfrac{r-g}{\max - \min} + 240°, \text{ if } \max = b \end{cases}$$

$$s = \begin{cases} 0, \text{ if } \max = 0 \\ \dfrac{\max - \min}{\max} = 1 - \dfrac{\min}{\max}, \text{ Otherwise} \end{cases}$$

$$v = \max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

15. The converting system as claimed in claim 9, wherein the saturation computing unit calculates the color saturation value of the HSV color space in accordance with the intermediate RGBW data by the equation below:

$$h = \begin{cases} 0°, \text{ if } \max = \min \\ 60° \times \dfrac{g-b}{\max - \min} + 0°, \text{ if } \max = r \text{ and } g \geq b \\ 60° \times \dfrac{g-b}{\max - \min} + 360°, \text{ if } \max = r \text{ and } g < b \\ 60° \times \dfrac{b-r}{\max - \min} + 120°, \text{ if } \max = g \\ 60° \times \dfrac{r-g}{\max - \min} + 240°, \text{ if } \max = b \end{cases}$$

$$s = \begin{cases} 0, \text{ if } \max = 0 \\ \dfrac{\max - \min}{\max} = 1 - \dfrac{\min}{\max}, \text{ Otherwise} \end{cases}$$

$$v = \max;$$

wherein r represents the intermediate R data, g represents the intermediate G data, b represents the intermediate B data, max represents the maximum value among the r, g, and b, min represents the minimum value among the r, g, and b, h represents the hue value of the HSV color space, s represents the saturation value of the HSV color space, and v represents the brightness value of the HSV color space.

* * * * *